United States Patent [19]

Fotsch

[11] 4,306,522

[45] Dec. 22, 1981

[54] TRANSFER PORT DUCT FOR TWO-STROKE ENGINES

[75] Inventor: William R. Fotsch, Wauwatosa, Wis.

[73] Assignee: Briggs & Stratton Corporation, Wauwatosa, Wis.

[21] Appl. No.: 160,852

[22] Filed: Jun. 19, 1980

[51] Int. Cl.[3] ..... F02B 33/04

[52] U.S. Cl. ..... 123/73 R; 123/65 PD; 123/73 PP; 123/73 A

[58] Field of Search ..... 123/73 PP, 73 R, 73 A, 123/74 R, 74 B, 65 PD, 65 P

[56] References Cited

U.S. PATENT DOCUMENTS

| | | | |
|---|---|---|---|
| 825,835 | 7/1906 | Holloway | 123/73 A |
| 1,145,208 | 7/1915 | Muzzy | 123/73 A |
| 1,443,517 | 1/1923 | Acre | 123/73 A |
| 2,146,919 | 2/1939 | Stihl | 123/73 A |
| 2,516,031 | 7/1950 | Talvio | 123/73 A |
| 3,494,335 | 2/1970 | Meier | 123/73 R |
| 3,730,149 | 1/1973 | Brown | 123/73 A |
| 3,815,558 | 6/1974 | Tenney | 123/73 R |
| 4,088,098 | 5/1978 | Rose et al. | 73 A/ |
| 4,194,470 | 3/1980 | Magner | 123/73 A |

FOREIGN PATENT DOCUMENTS

| | | | |
|---|---|---|---|
| 1052011 | 9/1953 | France | 123/73 A |
| 1285471 | 8/1972 | United Kingdom | 123/73 A |

*Primary Examiner*—Wendell E. Burns

*Attorney, Agent, or Firm*—Andrus, Sceales, Starke & Sawall

[57] ABSTRACT

A transfer duct construction for a two-stroke engine cylinder in which a transfer port in the cylinder wall has a side wall that is perpendicular to the parting line along which the cylinder is cast; a transfer port cover extends over the transfer port and includes an inner end wall having an inclined surface positioned adjacent the perpendicular side wall of the port to direct a fresh fuel-air charge away from an exhaust port.

4 Claims, 10 Drawing Figures

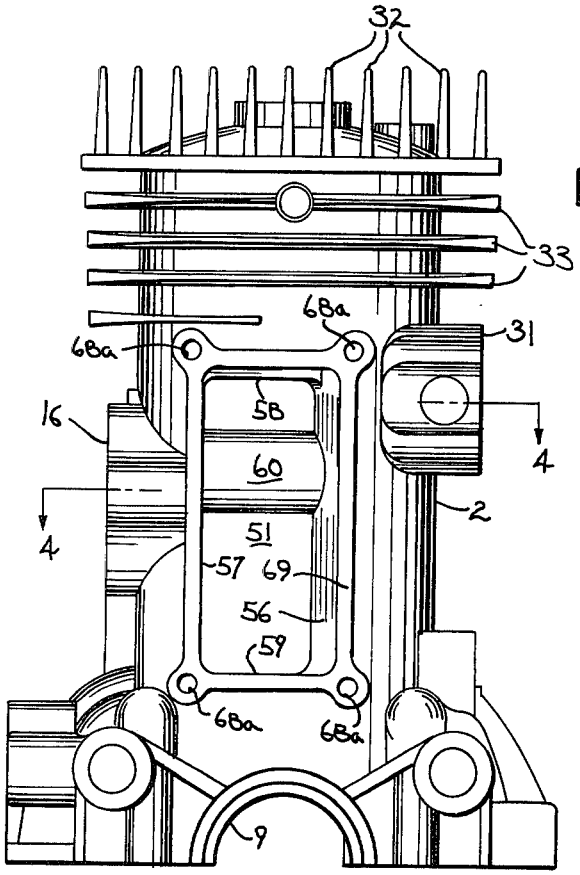
FIG.3
FIG. 5
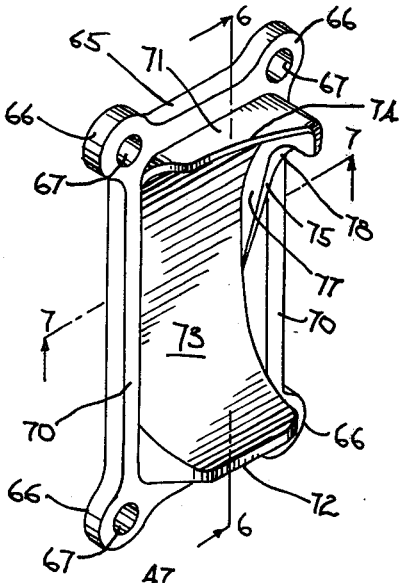
FIG. 4
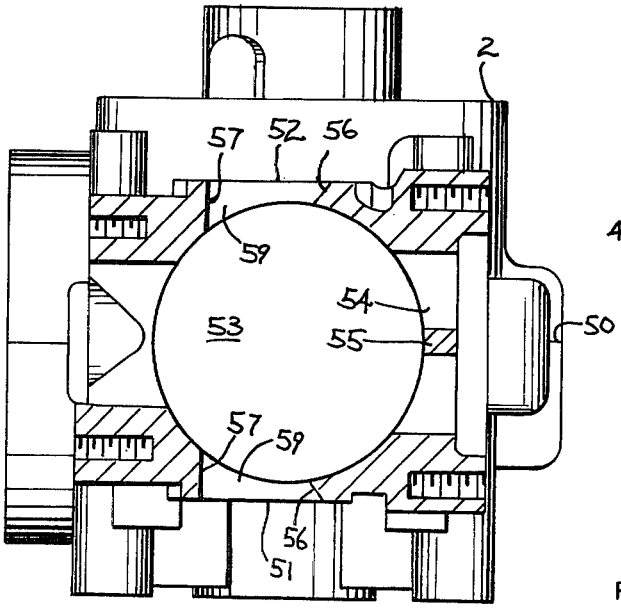
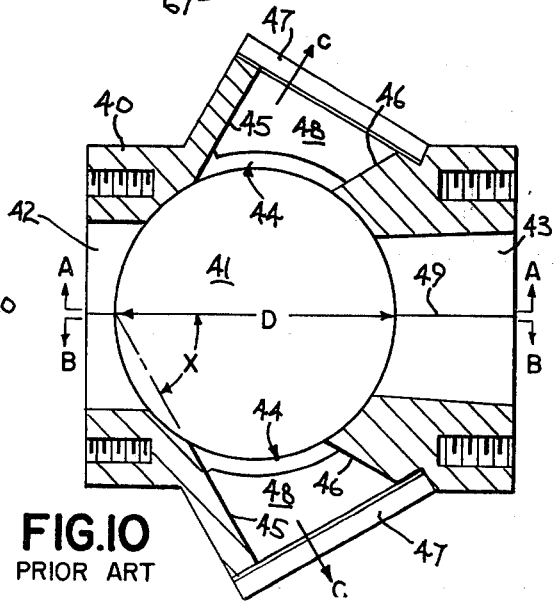
FIG.10
PRIOR ART

TRANSFER PORT DUCT FOR TWO-STROKE ENGINES

TECHNICAL FIELD

This invention is concerned with the construction of transfer port ducts for two-stroke internal combustion engines.

Background Art

In a crankcase-scavenged two-stroke internal combustion engine, often also referred to as a two-cycle engine, a fresh charge of fuel-air mixture is compressed in the crankcase of the engine during the descending stroke of the piston. Transfer ports extending through the cylinder wall become uncovered near the bottom of the descending stroke of the piston, and the compressed fresh charge flows from the crankcase through transfer port ducts and thence through the transfer ports into the combustion chamber above the piston for the compression and ignition cycles.

Two-stroke engines, particularly in the smaller sizes, typically have two spaced transfer ports positioned on diametrically opposed sides of the cylinder and one or more exhaust ports between the two transfer ports. Because the transfer ports through which the fresh charge enters the combustion chamber and the exhaust ports through which the burnt charge exits the combustion chamber are open simultaneously during a portion of the piston travel, it is known to manufacture the transfer ports with angled (or generally tangential) vertical side walls that direct the fresh charge into a portion of the combustion chamber opposite from the exhaust port(s) so as to minimize mixing of the fresh charge with the burnt charge. The transfer ports are formed as openings in the cylinder wall during casting of the cylinder, and transfer ducts are established by attaching port covers over the transfer ports to define a passageway leading from the crankcase to the transfer ports. The prior art two-stroke engines known to me have utilized a transfer port construction that requires the use of retractable cores in addition to the dies used to cast the main body of the cylinder in order to form the transfer ports, thereby adding significant cost to the diecasting equipment needed for their manufacture.

Disclosure of the Invention

According to my present invention, a transfer port is cast in a cylinder for a two-stroke engine with one of its vertical side walls perpendicular to the parting line along which the cylinder is cast and its other vertical side wall disposed at an acute included angle to the parting line; further, a port cover is formed to have an internal wall portion arranged to cooperate with the aforesaid perpendicular vertical side wall of the transfer port and define a transfer duct having a wall portion at its inlet end into the cylinder that is at an acute included angle relative to the parting line so as to direct the incoming fresh charge in a generally tangential direction away from the exhaust port formed in the cylinder. The incorporation of these features in a two-stroke engine provides several useful advantages as discussed in the description which follows, which advantages also represent the technical objectives sought to be attained by this invention.

BRIEF DESCRIPTION OF THE DRAWINGS

FIG. 3 is a front view of the cylinder of the engine of FIG. 1;

FIG. 4 is a sectional view of the cylinder along the plane of line 4—4 of FIG. 3;

FIG. 5 is a perspective view of a transfer port cover in accordance with this invention;

FIG. 10 is a horizontal sectional view similar to FIG. 8 but illustrating the transfer port construction of a typical prior art two-stroke engine.

BEST MODES FOR CARRYING OUT THE INVENTION

Figure 1:
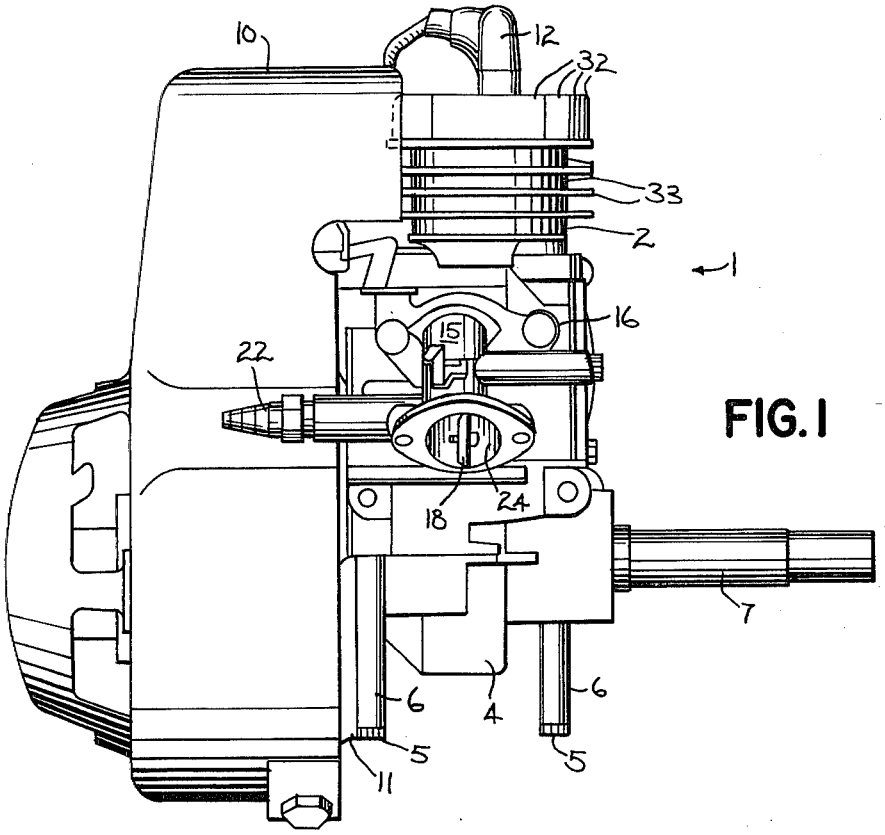
FIG. 1 is a side view of a two-stroke engine incorporating the present invention.
Figure 2:
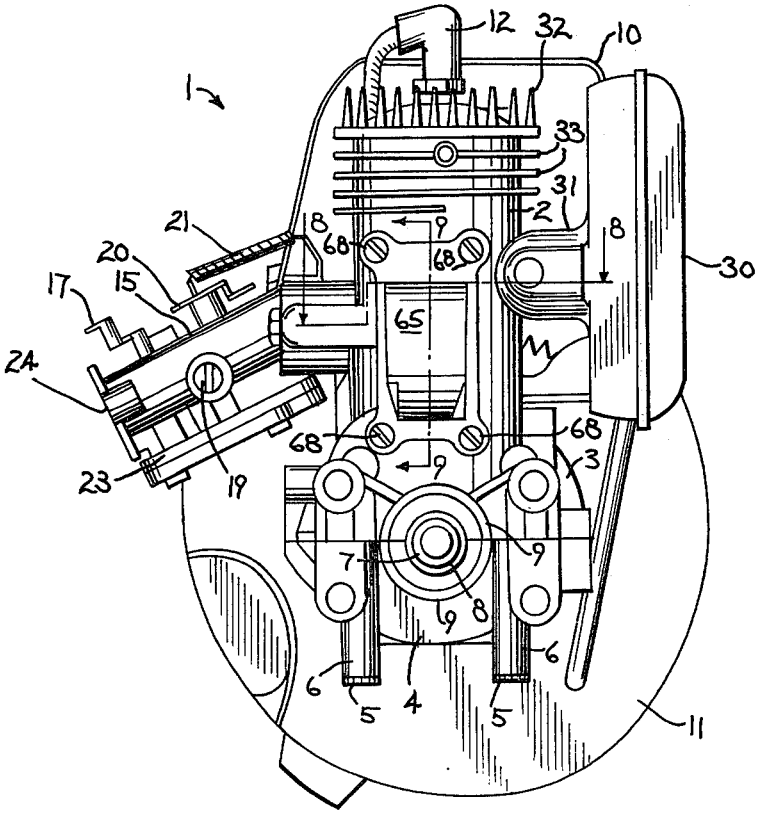
FIG. 2 is a front view of the engine of FIG. 1.

FIGS. 1 and 2 illustrate a third ported loop scavenged two-stroke engine 1 incorporating the transfer duct construction of the present invention. The following general description of the engine illustrating its conventional features is presented before proceeding with a detailed description of the new transfer duct.

(A) General Description

The engine 1 includes a cylinder 2 having a lower portion 3 which defines the upper part of the crankcase. A crankcase cover 4 is attached to the lower portion 3 of the cylinder by means of bolts 5 threaded through bosses 6 and into the base of the portion 3 to complete the crankcase enclosure. A horizontal crankshaft 7 is journaled in bearings 8 supported in complementary bearing hubs 9 formed as parts of the cylinder and the crankcase cover.

The power take-off end of the crankshaft is shown at the righthand side as viewed in FIG. 1 and the magneto end is at the lefthand side of the engine. The magneto end of the crankshaft is covered by a blower housing 10 which encloses a rewind starter mechanism, magneto, flywheel and blower (usually formed as one casting), and other normal elements, not shown, all of which can be of any selected design and form no part of this invention. A backplate 11 attached to the crankcase cover 4 completes the enclosure at the magneto end of the crankshaft. The engine 1 is shown as a spark ignited engine having a spark plug 12 connected to a magneto, not shown.

A carburetor 15 is bolted to a carburetor flange 16 formed as part of the casting for the cylinder 2 and includes a choke lever 17 connected to choke plate 18, a needle adjustment 19, throttle lever 20 and governor spring 21. Fuel from a fuel tank, not shown, containing a small proportion of lubricating oil, is fed into fuel inlet 22, usually by gravity feed, and then pumped into the carburetor by a diaphragm fuel pump 23 that is operated by the pressure differential developed in the crankcase. Fresh air enters the intake 24 and passes through the carburetor for mixture with the fuel charge, after which the fresh charge flows through an intake port not shown in FIGS. 1 and 2 and into the crankcase underneath the head of the piston, wherein it is compressed during the downward stroke of the piston.

A muffler 30 is attached to a muffler flange 31 (FIG. 3) cast as part of the cylinder 2. Vertical external cooling fins 32 extend across the top of the cylinder 2, and horizontal external fins 33 extend about the upper portion of the cylinder to provide an air-cooled engine.

The engine 1 as described to this point operates in the usual manner and incorporates the known elements typically found in a two-stroke engine; these do not form a part of the present invention, and the elements as illustrated can be replaced with other known elements, particularly with respect to the carburetor and fuel system, muffler, etc.

(B) Description of Prior Art Cylinder

FIG. 10 illustrates the transfer port and duct construction for a typical prior art two-stroke engine cylinder 40. The cylinder 40 is made as a diecast element having bore 41, intake port 42, exhaust port 43 and a pair of opposed transfer ports 44, all of the ports being formed as openings extending through the cylinder wall. The transfer ports 44 include spaced vertical walls 45 and 46 that are angled away from the exhaust port 43. The opening defined by the walls 45 and 46 is closed by a port cover 47, to thereby form a transfer duct 48 on each side of the cylinder that communicates with the crankcase at its lower end and with the transfer port 44 at its upper end to conduct the compressed fresh charge from the crankcase into the combustion chamber of the cylinder. The inner surface of the port cover 47 is often shaped to control the cross-sectional area of the transfer duct. The cylinder 40 is typically made by diecasting with a die made of two halves that separate along the parting line 49 in the directions indicated by the arrows A and B respectively; it will be noted that the vertical wall 45 of the two transfer ports cannot be parted in the directions of the arrows A and B because it is an interior wall of the cylinder casting that is arranged at an acute included angle X relative to the parting line. Accordingly, in order to make the cylinder 40, separate cores that retract in the direction of arrows C are required to create the two angled walls 45 and 46 of the transfer ports; these cores are in addition to the cores needed to mold the main body of the cylinder itself. This requirement, which is made necessary by the typical construction of the transfer ports and transfer duct in the prior art two-stroke engine, necessitates expensive diecasting equipment and increases the tooling costs of making the dies for casting the cylinders.

(C) Description of this Invention

Turning first to FIG. 4, the cylinder 2 of the engine 1 is a cast cylinder made with a die having two halves that separate along parting line 50. The cylinder has opposed transfer ports 51 and 52 formed in accordance with this invention which communicate with the cylinder bore 53. An exhaust port 54 is also cast into the cylinder and is centered upon the parting line 50 so as to be positioned midway between the transfer ports 51 and 52. A stiffening web 55 may extend across the exhaust port 54 to add rigidity if so desired.

Each transfer port 51 and 52 includes a first side wall 56 (see also FIG. 3) that is inclined relative to the parting line 50 so as to face away from the cylinder bore 53. Each transfer port also includes a second side wall 57 that is spaced from the first side wall 56 and arranged perpendicular to the parting line 50. Both the first and second side walls 56 and 57 extend along the axial direction of the cylinder. (It may be noted at this point that the corresponding vertical wall 45 in the prior art cylinder of FIG. 10 is arranged at an acute included angle X relative to the parting line 49 so as to face or open onto the cylinder bore 41.)

Upper wall 58 and lower wall 59 connect the side walls 56 and 57 to complete the openings in the cylinder wall defined by the transfer ports 51 and 52. The upper wall 58 is disposed above the TDC position of a piston reciprocating in the cylinder so that the upper portion of the transfer ports 51 and 52 communicates with the combustion chamber of the cylinder. The lower wall 59 is disposed below the BDC position of a piston in the cylinder so that the lower portion of the transfer ports 51 and 52 communicates with the crankcase of the engine. A bar 60 may extend across each transfer port as shown in FIG. 3 to impart structural rigidity and control airflow characteristics, if so desired.

A transfer port cover 65 of the structure illustrated in FIG. 5 is provided to cover the transfer ports 51 and 52 so as to define a transfer duct along each side of the cylinder. The transfer port cover 65 is a solid member and may include ears 66 with apertures 67 at each of its corners. The transfer port cover is attached to the cylinder 2 over each transfer port by means of screws 68 or other suitable fastening means which extend through the apertures 67 and are seated in holes **68*a* (see FIG. 3) defined in a generally rectangular boss 69 extending above each transfer port. The transfer port cover 65 has peripheral marginal portion 70 that surrounds a transfer port, the inner surface of which is to contact the outer wall of the cylinder 2 as by seating against boss 69, to form a seal about the transfer ports. FIG. 2 shows a transfer port cover 65 attached to the cylinder 2** in this manner.

Figure 6:
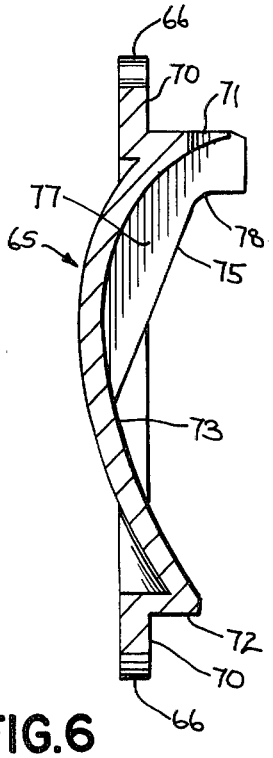
FIG. 6 is a vertical sectional view of the port cover shown in FIG. 5.

The transfer port cover 65 (FIGS. 5 & 6) has a top wall 71 and a bottom wall 72 which are spaced from each other and extend inwardly (relative to the cylinder bore) from the peripheral marginal portion 70, and a wall member 73 having a curved inner surface which extends between the top wall 71 and the bottom wall 72. The bottom wall 72 of the transfer port cover 65 is to be positioned alongside the lower wall 59 of a transfer port, and it extends inwardly a distance equal to or less than the cylinder thickness along the lower wall 59 so that no part of the bottom wall 72 extends into the cylinder bore. In a similar fashion, top wall 71 of the transfer port cover 65 is to be disposed alongside the upper wall 58 of the transfer port, and it extends inwardly from the inner peripheral surface 70 a distance equal to or less than the thickness of the cylinder wall along the upper wall 58 so that no part of it extends into the cylinder bore; further, the top wall 71 has its inner edge 74 curved so as to follow the contour of the cylinder bore. The wall member 73 of the port cover is connected to the peripheral marginal portion 70 and covers the opening formed by a transfer port.

Figure 7:
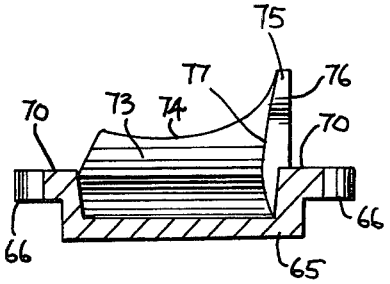
FIG. 7 is a horizontal sectional view of the port cover of FIG. 5.

The transfer port cover 65 also includes an inner end wall 75 that extends from an end of the top wall 71 downwardly to intersect the wall member 73. As best shown in FIG. 7, the outer surface 76 of the end wall 75 is perpendicular to the peripheral marginal portion 70 of the transfer port cover, as the surface 76 of the end wall 75 is to be arranged alongside the second vertical wall 57 of a transfer port when the cover 65 is attached to the cylinder. The inner surface 77 of the end wall 75 is disposed at an angle relative to the outer surface 76, for the purpose described in greater detail below. The inner end wall 75 is notched as at 78 so as to fit about the bar 60 when the bar is used across the transfer port.

Figure 8:
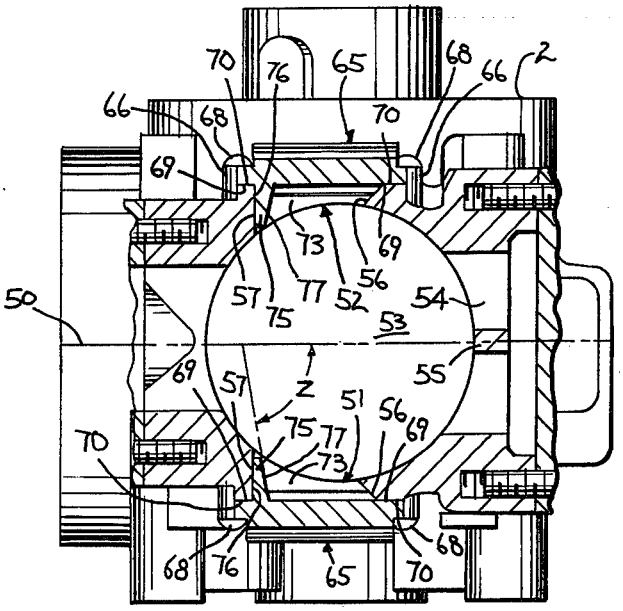
FIG. 8 is a horizontal sectional view along the plane of 8—8 of FIG. 2.
Figure 9:
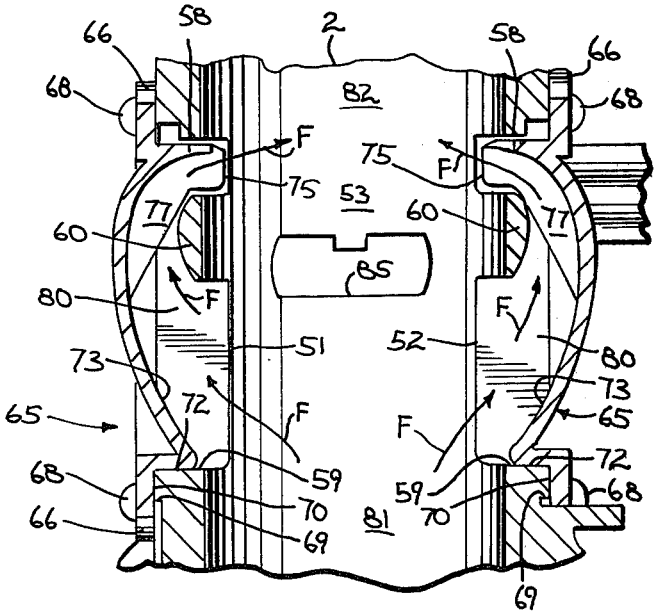
FIG. 9 is a vertical sectional view, with portions broken away, along the plane of line 9—9 of FIG. 2.

The horizontal and vertical sectional views of FIGS. 8 and 9 illustrate the transfer port cover 65 installed on the cylinder 2 over each of the transfer ports 51 and 52. The peripheral marginal portion 70 of the port cover is seated against the boss 69 surrounding a transfer port and the port cover is attached to the outer wall of the cylinder by means of the screws 68, as previously discussed. The wall member 73 covers the transfer port opening. The inner end wall 75 of each port cover bears against the second side wall 57 of each transfer port, with the outer surface 76 of the end wall 75 contacting or adjacent to the second side wall. The inner surface 77 of the inner end wall, which is at an angle relative to the outer surface, faces inwardly towards the bore 53 of the cylinder and is arranged along the axial direction of the cylinder; it is inclined at an acute included angle Z relative to parting line 50. Thus the inner surface 77 is angled away from the exhaust port 54 so as to direct a fresh fuel-air charge away from the exhaust port when entering the combustion chamber.

As indicated in FIG. 9, the curved inner surface of the wall member 73 of each port cover 65 defines the outer portion of a transfer duct 80 located on each side of the cylinder. Each transfer duct 80 communicates at its lower end with the lower portion 81 of the cylinder that forms part of the crankcase of the engine and at its upper end with the upper portion 82 of the cylinder that forms the combustion chamber above a piston reciprocating in the cylinder. A fresh charge of fuel-air mixture flows from the crankcase into the combustion chamber along the path shown by the arrows F in FIG. 9. The curved inner surface of the wall member 73 is preferably designed in such a manner that the cross sectional area of each transfer duct decreases as the charge approaches the combustion chamber so as to thereby obtain smooth accelerated laminar flow of the charge into the cylinder. FIG. 9 also shows the intake port 85 which is cast into the cylinder, through which a fresh fuel-air mixture from the carburetor 15 and intake 24 flows into the crankcase.

Several advantages of the transfer duct construction of this invention are demonstrated by the foregoing description. Each transfer port cast into the cylinder wall has its first side wall facing away from the bore of the cylinder and its second side wall 57 arranged perpendicularly to the parting line. This eliminates the need to use separate cores in order to form the transfer ports, which is necessary with the prior art cylinder construction shown in FIG. 10. This greatly simplifies the construction of the dies required to cast the cylinder, facilitates maintenance of the dies, and substantially reduces the tooling costs necessary to construct the dies. Instead of forming the second side wall as an angled part of the cylinder casting process, the present invention forms it as a portion of the port cover 65. This construction has another advantage in that the angle of inclination of the inner surface 77 of the end wall 75 of the port cover can be changed easily since this is a relatively small cast part and changes to the die for casting it can be made at low cost. This feature enables altering the angle of inclination Z of the wall in the event the engine designer desires to obtain differing types of flow of the fresh fuel-air mixture into the combustion chamber. This further leads to the possibility of utilizing the same cast cylinder construction for different engines by providing port covers with end walls having varying degrees of inclination in order to alter performance characteristics of the engines.

Industrial Applicability

The transfer duct construction of the present invention, combining a transfer port and port cover as described above, can be used with either a third ported loop scavenged or a reed valve type of two-stroke engine. Although illustrated in connection with a single cylinder two-stroke engine, the transfer duct construction can also be used with multiple cylinder two-stroke engines. The engine described herein is shown with a vertical cylinder, but the present transfer duct construction also may be utilized with engines having one or more horizontal cylinders. Thus, the present transfer duct construction may be employed with any type of two-stroke internal combustion engine.

I claim:

1. A transfer duct for a cylinder for two-stroke engine cast from separable dies to have a parting line, comprising, in combination:

(1) at least one transfer port having a first side wall that is inclined relative to the parting line and a second side wall spaced from the first side wall and arranged perpendicular to the parting line, and (2) a transfer port cover over said transfer port and including a wall member covering the transfer port and an inner end wall disposed adjacent to the second wall of the transfer port, the inner end wall having an inclined surface arranged at an acute included angle relative to the parting line.

2. In a two-stroke internal combustion engine, a cylinder cast from a pair of separable dies to have a cylinder bore in which a piston is to reciprocate, at least one transfer port extending through the wall of the cylinder, and a parting line along which the dies separate, an upper portion of the cylinder forming a combustion chamber and a lower portion of the cylinder forming part of the crankcase of the engine, an improved transfer duct construction comprising, in combination:

(1) each transfer port formed in the wall of the cylinder having (a) a first side wall that is inclined relative to the parting line and faces away from the cylinder bore, (b) a second side wall that is spaced from the first side wall and arranged perpendicular to the parting line, and (c) spaced upper and lower walls interconnecting the upper ends and lower ends, respectively, of the first and second side walls;

(2) a transfer port cover attached to the exterior wall of the cylinder over each transfer port and including (a) a wall member covering the transfer port, and (b) an inner end wall disposed adjacent the second side wall of the transfer port, said inner end wall having an inclined surface facing the bore of the cylinder along the upper portion thereof and arranged at an acute included angle relative to the parting line;

(3) each transfer port cover and transfer port defining a transfer duct communicating with the crankcase at its lower end and with the combustion chamber at its upper end for the transfer of a fresh change of fuel-air mixture from the crankcase to the combustion chamber.

3. The transfer duct construction of claim 2, wherein:

the wall member of the transfer port cover has a curved inner surface.

4. A transfer duct construction according to claim 2 or 3, wherein:

the transfer port cover includes a peripheral marginal portion which bears against the exterior wall of the cylinder, a top wall extending from the peripheral marginal portion and arranged alongside the upper wall of the transfer port, and a bottom wall extending from the peripheral marginal portion and arranged alongside the lower wall of the transfer port, the wall member of the transfer port cover extending between said top and bottom walls, and the inner end wall extending from the top wall of the transfer port cover to intersect the wall member.

* * * * *